United States Patent [19]

Ledbetter

[11] 4,420,211

[45] Dec. 13, 1983

[54] FLAT ELECTRICAL CABLE SPLICER

[75] Inventor: James A. Ledbetter, St. Charles, Ill.

[73] Assignee: Belden Corporation, Geneva, Ill.

[21] Appl. No.: 291,797

[22] Filed: Aug. 10, 1981

[51] Int. Cl.[3] ..... H01R 9/08

[52] U.S. Cl. ..... 339/98

[58] Field of Search ..... 339/97 R, 97 P, 98, 339/99 R

[56] References Cited

U.S. PATENT DOCUMENTS

| | | | |
|---|---|---|---|
| 2,587,239 | 2/1952 | Smith | 339/98 |
| 3,154,363 | 10/1964 | Will | 339/99 R |
| 3,444,506 | 5/1969 | Wedekind | 339/99 R |
| 3,816,818 | 6/1974 | Meier | 339/99 R |
| 3,820,058 | 6/1974 | Friend | 339/99 R |
| 3,858,159 | 12/1974 | Worth | 339/99 R |
| 3,877,771 | 4/1975 | Jensen et al. | 339/19 |
| 3,912,354 | 10/1975 | Campbell et al. | 339/99 R |
| 3,912,356 | 10/1975 | Johansson | 339/98 |
| 3,985,416 | 10/1976 | Dola et al. | 339/98 |
| 4,027,941 | 6/1977 | Narozny | 339/14 R |
| 4,037,905 | 7/1977 | Lucas | 339/98 |
| 4,047,784 | 9/1977 | Trank | 339/98 |
| 4,127,312 | 11/1978 | Fleischhacker et el. | 339/99 R |
| 4,190,952 | 3/1980 | Thomas et al. | 29/629 |

FOREIGN PATENT DOCUMENTS

| | | | |
|---|---|---|---|
| 2653357 | 6/1978 | Fed. Rep. of Germany | 339/98 |

*Primary Examiner*—Joseph H. McGlynn

*Attorney, Agent, or Firm*—Fitch, Even, Tabin & Flannery

[57] ABSTRACT

The present invention relates to a splicer for multi-conductor flat electrical cable. The splicer is conveniently manufactured from two part types: housing members and piercers. The top and bottom housing members are identical in structure, the structure including a plurality of longitudinally extending slots arranged symmetrically. Piercers are snugly fit into the bottom member of the housing prior to the effectuation of a splice; when the splice is effected, the tops of the piercers snugly fit into the identical slots of the top member of the housing. The piercers are designed to pierce the insulation of electrical cables and to effect electrical contact between predetermined conductors. Complementary aligning and locking means are also provided for each of the housing members.

8 Claims, 13 Drawing Figures

FLAT ELECTRICAL CABLE SPLICER

BACKGROUND OF THE INVENTION

The present invention relates to the field of splicing devices for multi-conductor flat electrical cables.

The use of flat flexible multi-conductor cable for interconnecting electrical components and devices has become increasingly popular in recent years and has engendered the design of various connectors, terminators and splicers adapted to such cable. In many cases the user is required to strip insulation from selected portions of the conductors to permit the electrical connection thereof to the contact elements of such devices. Devices using multiple piercing elements have been disclosed for cable termination. However, these do not permit the direct connection of one cable to another, but require each of two cables to be terminated prior to connection.

It is often more expedient to directly tap or splice cables together. Several types of splices are possible between two cables. Two cables may be joined at the end ("V" splice) or one end may be spliced along the extent of another cable ("Y" splice) or two cables might be spliced along their extent ("X" splice). It is desirable to have a single device for all three purposes. While some flat cable splices have been developed they have been limited to one conductor splicers, or to devices which would not accomplish all three types of splices. One problem in developing such a device is to permit cable exit where a cable is spliced in the middle, and yet provide device closure for end connections to protect the otherwise exposed ends against possible shorting by unwanted electrical contacts. Another challenge is to provide such a device which is very economical to manufacture and is easy to use.

SUMMARY OF THE INVENTION

In accordance with the present invention, a versatile, effective and economical splice for a multi-conductor flat electrical cable is presented. The disclosed device is capable of effecting "V", "Y" and "X" type splices, while providing protection against possible shorting.

The device is entirely constituted by a top member, a bottom member and a series of piercers. The structure of the top member is identical to the structure of the bottom member, and the piercers are identical to one another so that only two distinct part types are required. This results in considerable savings in manufacturing expense. The top member and bottom member conveniently snap together so as to form a securing housing with frangible dead seals which are broken or displaced when a connection is made along the extent of a cable, and which remain closed when a connection is made at the end of a cable. Thus, an opening is made available when needed, and when no opening is required, the seals provide protection for the cable ends.

The top member and bottom member have slots for receiving either the tops or bottoms of the piercers. The piercers, which have a base and insulation piercing prongs, have a width across the prongs equal to the base width so that either end of each piercer can fit snugly into any of the slots. The slots are arranged symmetrically about a plane perpendicular to the length of the slots so that the slots in the top member vertically align with the slots in the bottom member. Ends of each housing member are designed complementarily about the same plane so that two such structures may be snapped together to constitute the splice housing.

Accordingly, a versatile and economical splice, which may be formed from two types of parts, is presented which affords protection to cable ends.

The primary object of the present invention is to provide an improved splicer for multi-conductor flat electrical cables.

Another object of this invention is to provide an improved splicer capable of effecting "V", "Y" and "X" splices.

It is also an object of this invention to provide an improved splicer which protects cable ends from environmental exposure.

A more specific aim of this invention is to accomplish the above objects using only two part types.

Other objects and features of the present invention are apparent in the following drawings, description and claims.

DESCRIPTION OF THE PREFERRED EMBODIMENTS

Figure 1:
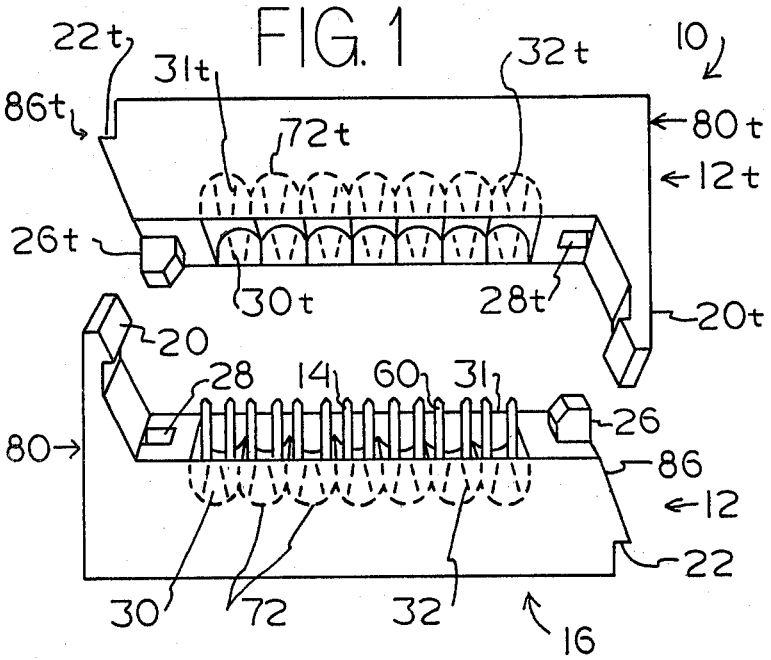
FIG. 1 is a perspective view of a splicer in accordance with the present invention.

In accordance with the present invention, a splicer 10 is shown in FIG. 1 as it would appear after manufacture and prior to effectuation of a splice. The splicer has a bottom assembly 16, constituted by a bottom member 12 and a plurality of piercers 14, and a top member 12t. (The letter "t" appended to a reference number indicates that the element referred to is associated with the top member and is otherwise identical to the referent associated with the bottom member with the same number.) The top member and the bottom member are of identical structure, and when engaged by means of clips 20 and lips 22 constitute the splicer housing 24 shown in cross section in FIG. 2. Alignment pins 26 and cavities 28 facilitate the assembling of the splicer 10 so as to effect a splice. The top and bottom members each include dead seals 30/30*t* and 31/31*t* with reduced strength lines 32 which allow bending and breaking of the seal to allow cables to extend into or through the housing. The seals remain closed when no cable extends through the area covered by the seal so that cable ends may be protected against shorting.

Figure 3:
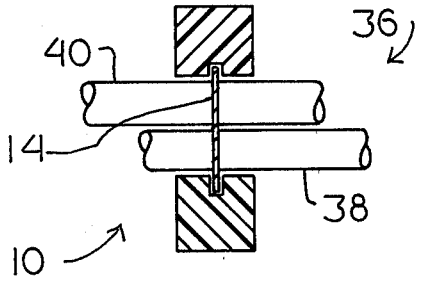
FIG. 3 is a sectional view of an "X" splice using the device of the present invention.
Figure 4:
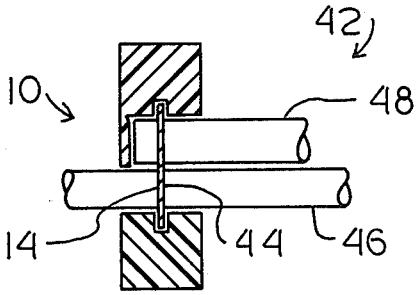
FIG. 4 is a sectional view of a "Y" splice using the device of present invention.
Figure 5:
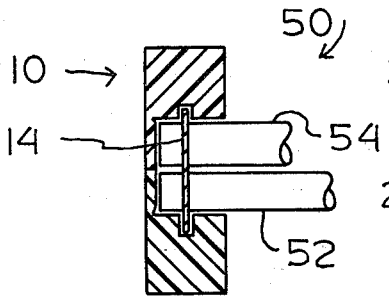
FIG. 5 is a sectional view of a "V" splice using the device of the present invention.

The present invention is capable of effecting all three major splice types, "X", "Y" and "V". FIG. 3 illustrates an "X" splice 36 between a flat cable 38 and another cable 40, the splice being taken along the extent of each cable. FIG. 4 teaches a manner in which the splicer can be used to effect a "Y" splice 42 joining a point 44 along the extent of a flat cable 46 with the end of a second cable 48. Alternatively, a "Y" splice joining the end of a flat electrical cable to a point along the extent of a second cable could be effected. FIG. 5 shows the splicer effecting a "V" splice 50, joining the ends of a flat cable 52 and another cable 54.

Figure 2:
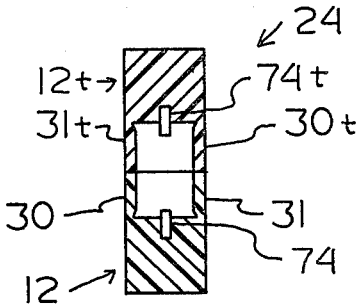
FIG. 2 is a sectional view of an assembled splicer housing in accordance with the present invention.
Figure 6:
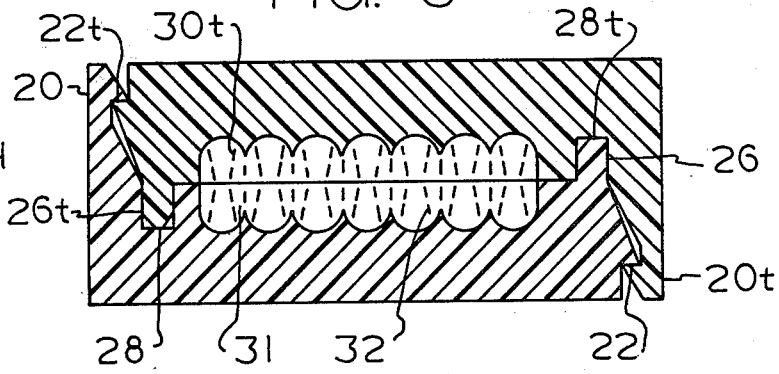
FIG. 6 is a sectional view of an assembled splicer in accordance with the present invention.
Figure 7:
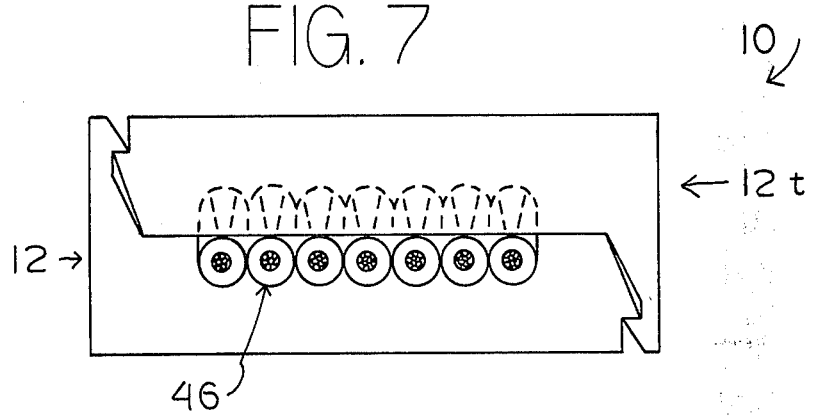
FIG. 7 is front elevational view of the splicer with one cable protruding.
Figure 8:
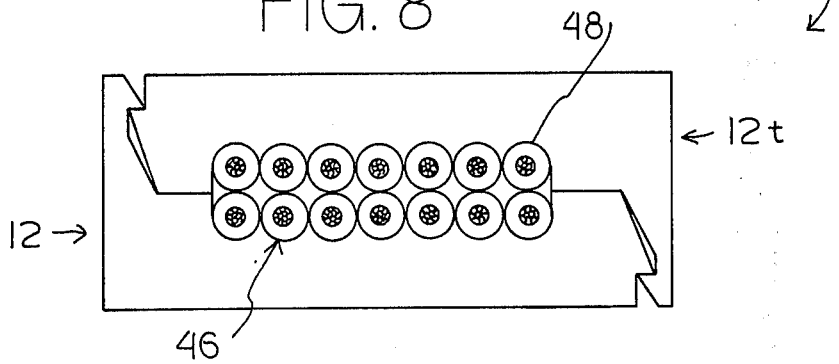
FIG. 8 is a front elevational view of the splicer with two cables protruding.

FIG. 6 is a sectional view of an assembled splicer 10 with the dead seals 30*t* and 31 intact as might occur when no cables are inserted as in FIG. 2 or at the cableless side of a "V" splice as in FIG. 5. FIG. 7 shows an assembled splicer 10 with only the flat cable 46 protruding as would appear at the tail side of a "Y" splice such as the one shown in FIG. 4. The lower seal has been displaced by the flat cable 46, while the top seal 31*t* continues to form an insulating barrier where there is no splice wire. All three major types of splices involve two wires extending through at least one side as depicted in FIG. 8; in such a case, the seals are totally displaced.

Figure 9:
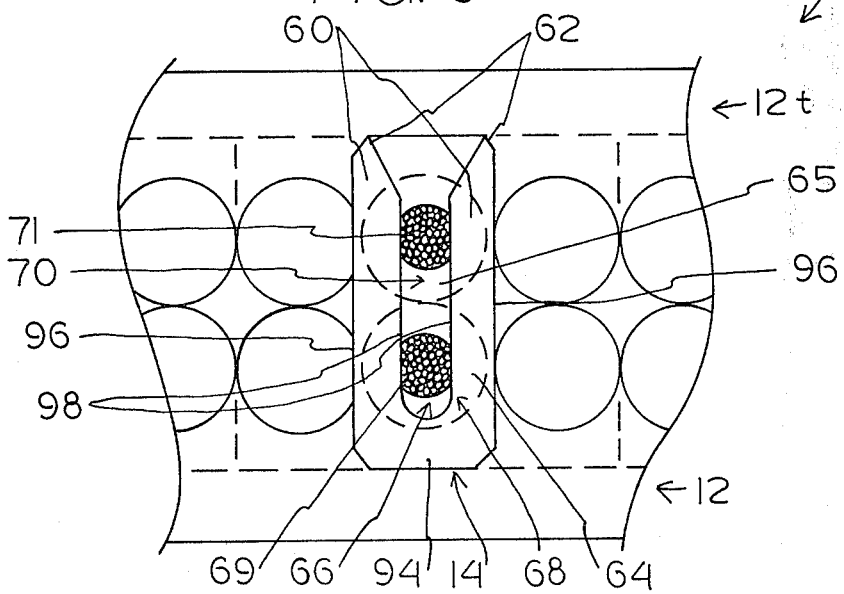
FIG. 9 is a sectional view of a splice effected in accordance with the present invention.

The splicer 10 effects an electrical connection in the manner illustrated in FIG. 9. Prongs 60 of each piercer 14 include tips 62, which are capable of piercing the insulating material 64. TLhe prongs are spaced apart from one another so as to define a cable receiving area 66 therebetween. The width of the cable receiving area approximates the conductor diameter of the cables for which the splicer is designed so that the prongs effect an electrical contact with the conductors 69 and 71 of the cables 68 and 70 to be spliced. In the case of cables with stranded conductors, the spacing of the prongs may be somewhat less than the nominal diameter of the conductors; the strands of the conductor will tend to rearrange to conform to the spacing of the prongs. The depth of the cable receiving area must be adequate so that the thicknesses of a flat electrical cable and a second cable may be contained therein. The piercer consists of conducting material so that an electrical connection is established between the cables when the splice is effected.

All three types of splices may be simply and conveniently effected using the disclosed splicing device. Referring again to FIG. 1, a flat cable may be laid upon the bottom assembly 16, aligned by means of the prongs 60 and arcuate depressions or serrations 72 of the bottom member 12. A second cable or series of cables may be placed over the appropriate conductors of the flat cable and may be held in alignment by the serrations 72*t* of the top member 12*t*, which is then placed over the cables and the bottom assembly. Proper alignment between the bottom assembly 16 and the top member 12*t* is assured by the engagement of alignment pins 26 with the alignment cavities 28. The bottom assembly and top member are pressed together until the locking clips 20 snap into the lips 22, at which time the splicer 10 is assembled and the splice is effected.

Referring back to FIG. 9, as the bottom assembly 16 and top member 12 are pressed together the piercers 14 cut through the insulation 64 of the flat cable and make electrical contact with the conductors 69 of the flat cable 68; subsequently, the piercers cut through the insulation 65 of the conductors of any second cable or series of cables, again so as to effect electrical contact. Being of conducting materials, the piercers which have contacted both a conductor of the flat cable and another conductor, effect an electrical splice therebetween.

The splicer is constituted by a bottom member 12, a top member 12*t* and a plurality of piercers 14. The top member and bottom member are identical in structure, so only the bottom member will be described in detail.

Figure 10:
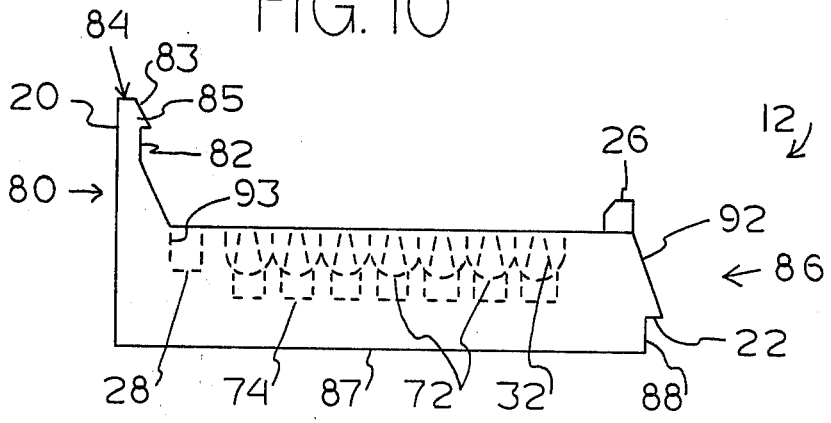
FIG. 10 is a side elevational view of a botom member of a splicer in accordance with the present invention.
Figure 11:
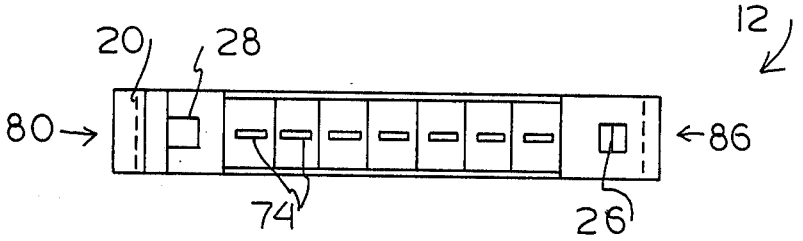
FIG. 11 is a plan view of the bottom member of FIG. 10.

Regarding the first preferred embodiment, the bottom member 12, molded of dielectric material, includes a series of collinear slots 74, best seen in FIGS. 10 and 11, having a pitch equal to that of the flat cable for which the splicer is designed; the slots are along or near the longitudinal median of the bottom member 16. The length of the slots 74 is less than the pitch of the slots. The bottom member has a plurality of serrations 72 aligned in one-to-one correspondence with the slots. The bottom member includes dead seals 30 and 31 with reduced strength lines 32 which allow breaking and bending to permit a cable and/or a plurality of cables to pass therethrough.

At a clip end 80 of the bottom member 12 is a clip 20 with a stem 82 and a head 84 having a protrusion 85 for engaging a lip 22*t* on a lip end 86*t* of the top member 14 identical to a lip end 86 of the bottom member. A bottom lip 22 on the bottom lip end 86 is adapted for engaging a clip 20*t* identical to the clip 20 of the bottom member. The lip 22 is formed between an indented portion 88 and a sloped portion 92 of the lip end. Adjacent the clip 20 of the bottom member is a cavity 28 for receiving an alignment pin 26*t* on the top member 14 identical to an alignment pin 26 adjacent the lip end 86 of the bottom member.

Since the bottom member 12 is constructed so as to mate with an identical top member 12*t*, the following dimensional requirements are met. The base 87 of the bottom member to the head 84 of the clip 20 constitutes the vertical extent of the splicer 10. The head 84 of the clip 20 has the same vertical extent as an indented portion 88 of the lip end 86. The lateral extent of the protruding portion 85 is the same as the lateral extent of the lip 22. The vertical extent of the stem 82 of the clip is equal to the vertical extent of the sloped portion 92 at the lip end 86. The height of the alignment pin 26 is equal to the height of the wall 93 of the cavity 28 nearer the clip end 80. The distance between the base 87 and the top of the dead seals 30 and 31 is equal to one half the height of the assembled splicer.

Additionally, the total of the heights of the dead seals 30 and 31 is slightly larger than twice the pitch of the cable for which the splicer is designed. The slope of an inner face 83 of the head 84 is equal to the slope of the sloped portion 92 at the lip end 86 so that the clip 20 may slide along the sloped portion of the top member 12*t* so as to set the clip 20 for engaging the lip 22 of the top member.

The top member 12*t* is identical in structure with the bottom member 12 just described. The complementary construction of each housing member provides for the convenient mating of top member and bottom member. The seals 30 and 31 and serrations 72 of the bottom member serve as bottom member means for receiving a flat electrical cable. The corresponding elements of the top member serve as top receiving means for receiving the cable or cables to be spliced with the flat cable.

Each of the plurality of piercers 14 is designed so that its top fits snugly into one of the slots 74, and so that its base snugly fits into one of the slots. More specifically, and with reference to FIG. 9, each preferred piercer 14 has a base 94 approximately as broad as each slot is long, and approximately as thick as each slot is wide. Each piercer has two prongs 60, each prong having an insulation piercing tip 62. Except in the region of the tips, the outer 96 and inner edges 98 of each prong are parallel with each other and with the edges of the opposing prong. The breadth of the piercer across the parallel outer edges of the prongs is equal to the breadth of the base and, therefore, to the length of the slots in the housing members. Thus, the upper portion of the piercer snugly fits in the slots of the top member. The height of the piercer is chosen so that the base of the piercer snugly fits into the bottom member while the upper portion of the piercer fits into the slots of the top member.

The inner edges 98 of the prongs 60 of a piercer 14 are spaced a distance approximately equal to the diameter of a conductor, defining the cable receiving space 66. When the bottom assembly 16 and the top member **12*t* are pressed together with cables therebetween, the tips 62 of the prongs 60 pierce the insulation of the flat cable and then the insulation of the second cable. The cables are aligned by means of the serrations 72*t* and 72 in the top member 12*t* and bottom member 12** so that each conductor is straddled by the two prongs of a single piercer. The height of each prong is greater than twice the pitch of the flat cable so that two conductors may be stacked vertically between the prongs of each piercer. Each piercer makes electrical contact with the flat cable along the inner edges of the prongs. Each piercer straddling two conductors makes physical and electrical contact with each thereby making an electrical connection between the two conductors, thereby effecting a splice.

The dimensions for the splicer are a function of the cable for which the specific splicer is designed. Given a flat cable with conductors of 14 to 20 AWG on a pitch of 0.156 or greater, a splicer with a single row of slots, as employed in the first preferred embodiment, is favored. Piercers with a cable receiving space width, or "prong spacing", of 0.043" are appropriate for conductors of 14 to 18 AWG; piercers with a prong spacing of 0.035 AWG are appropriate for conductors of 18 to 20 AWG.

In the case of a flat electrical cable with ten conductors of 18 AWG on a 0.156" pitch the following splicer parameters may be employed. Ten collinear slots on a 0.156" pitch may be employed. The basic piercer dimensions may be: height 0.296", breadth 0.078", and thickness 0.031". The cable receiving space may be 0.156" deep and 0.035" wide. The base of the piercer may be 0.062" in height, leaving 0.078" for the tips of the prongs. The slots in the splicer members may be 0.078" long and 0.031" wide so as to accommodate the piercers. The members may be approximately 1.75" long, 0.25" wide and 0.375" high. The assembled splicer may have similar dimensions, with the height being greater by a few mils.

It is important that the piercers do not contact one another once a splice is effected; otherwise the electrical currents in the conductors will interfere with each other. This requires that the piercers be arranged on a pitch greater than their breadth. In practice, the piercers should be spaced at least a few hundredths of an inch apart from one another. However, many cables have a pitch smaller than that necessary to accommodate the preferred piercer and piercer spacing in a collinear arrangement.

The desired spacing might be achievable by further miniaturizing the piercers. However, the weakened smaller piercers would be more susceptible to bending. The increased possibility of bending would make piercing less certain and, perhaps, lead to shorting among the piercers. Consequently, while the splicer of the first preferred embodiment is suitable for cables with conductors on a pitch of at least 0.100", a staggered-row arrangement of slots is favored for cables of lesser pitch.

Figure 12:
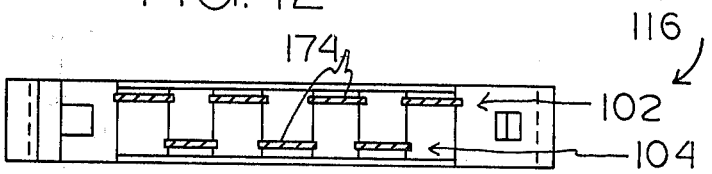
FIG. 12 is a plan view of a bottom member of a splicer in accordance with a second embodiment of the present invention.

Accordingly, the bottom assembly 116 of a second splicer in accordance with the present invention is shown in FIG. 12 with two staggered rows 102 and 104 of slots 174. Each row of slots has a pitch twice that of the flat cable to be received therein. In order to meet the condition of symmetry—in order that identical top and bottom members may be interfitted—the total number of slots is odd and one row has one more slot than the other, as shown. The width of the housing may be adjusted to accommodate the two rows of slots. Otherwise, the structure of the second embodiment follows the general plan of the first embodiment. The first and second embodiments operate similarly.

For flat electrical cables with conductors of 30 to 22 AWG on a 0.050" pitch the piercers may be manufactured with the following dimensions: height 0.190", breadth 0.050", and thickness 0.020". The depth of the cable receiving slot of the piercers, defined by the parallel inner edges of the prongs may be 0.100"; the base of the piercer may be 0.040" in height, leaving 0.050" for the tips of the prongs. The distance between the inner edges of the prongs may be 0.016" in the case of piercers designed for cables with conductors between 26 and 22 AWG; the distance may be 0.010" in the case of piercers designed for cables with conductors of 30 to 28 AWG. By manufacturing piercers with different distances between the prongs, but with identical outer dimensions, one may economically use one housing type for several different cable sizes. The splicer housing may measure 1.125" by 0.375" by 0.25". The slots would be 0.050" by 0.020" to accommodate the piercers.

Further embodiments incorporating more rows of slots and piercers for cables of smaller pitch are possible. It is also practical to manufacture a splicer in accordance with the present invention with three staggered rows when the cable pitch so requires. The preferred three row arrangement, shown in the bottom assembly 216 of a third preferred embodiment (FIG. 13), includes two orthogonally aligned outer rows 202 and 206 and a staggered center row 204. The piercers 208 may be arranged in step-like arrangement in the bottom member 212 as shown. The slots 213 without piercers are necessary in order that the top member and the bottom member may be manufactured identically. The slots (not shown) in the top member (not shown) corresponding to the empty slots of the bottom member as shown receive the piercers in the outer rows of the bottom member.

Figure 13:
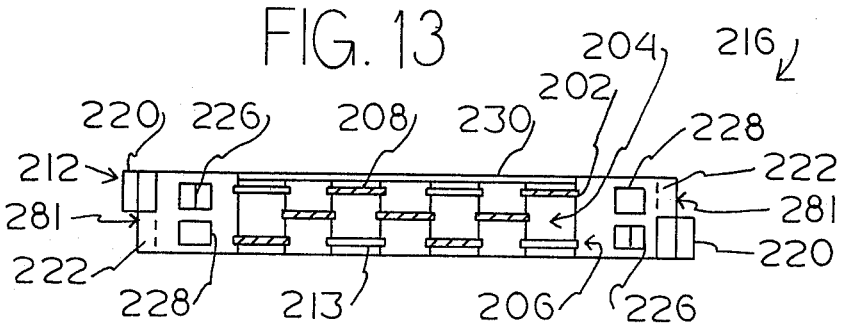
FIG. 13 is a plan view of a bottom assembly of a splicer in accordance with a third embodiment of the present invention.

The splicer bottom assembly 216 of FIG. 13 differs from the first two embodiments in having one dead seal 230 rather than two and a different mating system, including one clip 220 and one lip 222 at each end 281 of the housing member; similarly, there are alignment pins 226 and cavities 228 at each end of the bottom member 212. This more complex mating system adds a longitudinal plane of symmetry of the slots to be utilized in mating the bottom assembly 216 to a top member. When the splicer is assembled, the dead seals, to the extent they remain intact, are disposed on opposite sides of the splicer. This arrangement of seals and mating means is applicable to embodiments incorporating an odd number of rows of slots, including a single row embodiment.

Other variations are possible. Clearly, the specific dimensions of the splicer must be accommodated to the cables to be spliced. The seals are not required in all environments. The piercers could be redesigned so that electrical contact could be made between conductors with significantly different diameters. Solid walls instead of the dead seals could be used where a particular type of splice is anticipated. Other engaging, aligning and locking means could be designed. These and other variations upon the described embodiment can be made without going beyond the spirit and scope of the present invention.

What is claimed is:

1. An apparatus for splicing one or more conductors of a flat cable to corresponding conductors in an adjacent overlying cable or cables comprising a housing formed of two housing members which are adapted to interengage with each other, each housing member having a generally rectangular surface contoured face formed of insulating material having a plurality of colinear grooves therein so as to conform to one side surface of said flat cable so that a short length of said flat cable can lie along and nest within said contoured surface, each of said housing members having facing grooves of substantially identical shape, means projecting upwardly from at least one end of each housing member which is adapted to interlock with the opposite end of the other housing member to interengage said housing members, said contoured faces of said housing members extending generally parallel to and facing each other when said housing members are interengaged, the grooves of the interengaged housing members being spaced apart a distance approximately equal to the thickness of the overlying cables which are to be spliced together so as to snugly hold said cables in said overlying position, and one or more upwardly extending generally U shaped piercing members formed of conductive material and having a lower end extending downward from the closed end of the U which extends into and tightly fits within a corresponding slot extending downwardly from the contoured face of one of the shell sections, the upward extending sides of said piercing means forming spaced apart prongs which are adapted to pierce through the insulation of said overlying cables and extend into a corresponding slot in the facing housing member of said interengaged housing members, the prongs of each piercing member being of such width and spacing that when the two shell sections are interengaged it selectively pierces the insulation of and tightly engages a pair of selected overlying conductors of the cables which are to be spliced together, and end seal means at the ends of the grooves for selectively being open to cables passing through and closed to protect cable ends terminating in the apparatus.

2. A splicer for splicing a flat multi-conductor electrical cable with one or more other cables comprising: indentical and interengageable top and bottom housing members, and a plurality of piercers, each said housing member being of dielectric material having longitudinal slots, the slots being arranged symmetrically about a plane perpendicular to the slots, each of the slots being of length approximately equal to the breadth of one of said piercers and being of width approximately equal to the thickness of one of said piercers, each said housing member having a male locking means and a female locking means in complementary positions at opposing longitudinal ends of each said housing member so that each said housing member can be locked in engagement with an identical structure, each of said housing members including a cable receiving means for receiving at least one cable thereon to be spliced; each of said piercers being of conducting material, each piercer having a predetermined breadth and thickness, each piercer having prongs with piercing tips for piercing the insulation of a flat multi-conductor electrical cable, each piercer having an integral base, the prongs being flat and coplanar, the breadth of the prongs near the tips;

each of said piercers being secured within a slot of said bottom housing member so as to constitute a bottom assembly, so that, when a flat electrical cable is received within the receiving means of the bottom housing member and one or more other cables are received within the top housing member receiving means, the top housing member may be locked to the bottom assembly while electrical contact is made between predetermined conductors of a flat electrical cable with predetermined conductors of a second electrical cable by means of the piercers, and end seal means at the ends of the cable receiving means being selectively positioned to an open position to allow a cable to pass therethrough or to a closed position to protect a cable end terminating in the housing members.

3. The splicer of claim 2 further characterized in that the slots are arranged symmetrically about a plane perpendicular to the slots.

4. The splicer of claim 2 further characterized in that the slots are arranged symmetrically about a longitudinally extending plane.

5. The splicer of claim 2 further characterized in that said housing members include a male alignment means at one longitudinal end and a female alignment means at the opposite end so that the housing members may be more easily aligned with one another for purposes of locking engagement.

6. The splicer of claim 1 or claim 2 further characterized in that the slots of said housing members are arranged with predetermined pitch along a longitudinal row.

7. The splicer of claim 1 or claim 2 further characterized in that the slots of said housing members are arranged in a plurality of staggered rows of predetermined pitch.

8. The splicer of claim 1 or claim 2 further characterized in that said end seal means includes a plurality of dead seals with reduced strength lines to enable the dead seals to be bent or to be broken off to allow cables to pass through the housing members.

* * * * *